United States Patent [19]

Gugel et al.

[11] Patent Number: 4,674,179

[45] Date of Patent: Jun. 23, 1987

[54] MAKING AN ARMATURE ASSEMBLY FOR MATRIX PRINT HEADS

[75] Inventors: Bernd Gugel, Ulm-Einsingen; Harald Niebel, Senden; Hubert Ott, Ravensburg; Horst Heisele, Asselfingen; Herbert Kitzberger, Niederstotzingen; Wolfgang Seybold, Ulm, all of Fed. Rep. of Germany

[73] Assignee: Mannesmann AG, Duesseldorf, Fed. Rep. of Germany

[21] Appl. No.: 822,867

[22] Filed: Jan. 27, 1986

[30] Foreign Application Priority Data

Jan. 25, 1985 [DE] Fed. Rep. of Germany ..... 3502472

[51] Int. Cl.[4] ..... H01F 7/06; H01R 43/00

[52] U.S. Cl. ..... 29/602 R; 29/418; 29/622; 29/884

[58] Field of Search ..... 29/602 R, 622, 879, 29/884, 882, 418; 400/124; 101/93.05; 200/245, 246, 273, 274

[56] References Cited

U.S. PATENT DOCUMENTS 3,921,277 11/1975 Tramposch ..... 29/418

4,618,276 10/1986 Blomquist et al. ..... 29/602 R X

*Primary Examiner*—Carl E. Hall

*Attorney, Agent, or Firm*—Ralf H. Siegemund

[57] ABSTRACT

The armature assembly for matrix print heads having a plurality of magnetic drives for a corresponding plurality of print elements is made by providing an annular armature ring and positioning a disc annulus inside the armature ring in a concentric relation thereto; a resilient arm ring is superimposed upon the disc and armature ring so as to establish concentric placement thereto; the arm ring is fastened to the armature ring and the arms of the arm ring to the disc such that the ring arms extend above an annular gap between the armature ring and the disk; subsequent slots are thermally cutting into the disk to obtain individual armature arms, the slots extending into and through said annulus to divide the annulus into individual arms that remain connected to the armature ring on account of the fastening. The disk may have been cut out from the armature ring.

4 Claims, 12 Drawing Figures

MAKING AN ARMATURE ASSEMBLY FOR MATRIX PRINT HEADS

BACKGROUND OF THE INVENTION

The present invention relates to the manufacture and arranging of an armature assembly for a matrix print head of the type used in serial or line printers whereby the armature is basically constructed from an outer armature ring and azimuthally distributed, inwardly directed resilient armature arms.

An armature unit or multiple armature assembly of the type to which the invention pertains is used in matrix print heads in conjunction with and as a constituing element for the drives for print elements which drives include additionally electromagnets and/or permanent magnets. In the case of a serial printer such a print element is a stylus, a needle or a wire which is propelled with a relatively large force from a normal or zero position in a direction so as to obtain printing by impacting against an ink ribbon and print material such as a sheet on a platen. As a consequence, a print dot is produced is on that sheet. The print element is fastened to a respective resiliently constructed or mounted armature arm which is, additionally, mechanically resiliently biased, for example, through a deflecting field set up by a permanent magnet. An electromagnetic field of the driver is set up for temporarily removing this permanent magnetic bias from the armature so that under the force of the previously established resilient bias, now being released, the stylus, needle or wire will be propelled forward to obtain the printing action as described. Such a magnet system is also termed a biased system or better a tension biased, magnetic system because the resilient armature arms are mechanically tensioned through the use of a permanent magnet.

Matrix print heads of the type elaborated in the previous paragraph have been developed and are, in fact, in use on a large scale and they are manufactured by mass production. Owing to the rapidly expanding market of matrix printers, the number of print heads produced is quite large, but the requirements for accuracy has remained. In the case of serial print heads an overall print speed of above 200 characters per second has been developed bearing in mind that each character is composed of a number of such print dots, and many of them will be produced sequentially rather than in parallel. On the other hand, the use-life of such a printer, in order to be marketable, should be extensive which requires a capability of writing several, even many millions of characters. It can readily be seen that mass production is not a simple production engineering task.

German printed Pat. No. 30 79 03 and European printed patent application No. 9 873 describe the manufacture of an armature unit for matrix print heads of the type mentioned above in which a rather thin armature ring is provided with radial slots to thereby establish resilient armature arms. Longitudinal components are mounted to these armature arms and fastened thereto. On the tip of these longitudinal components one arranges the print needle, wire or stylus. After assembly of the matrix print head these longitudinal components will slide in a guide slot of a mounting and cover plate. In order to permit such movement, of course a certain clearance and play is necessary between that longitudinal component and the walls bounding the guide slot. The play or clearance, however, must not be excessive. The gap width should be as small as possible in order to permit movement without "looseness". Therefore, very tight and/or very expensive tolerances have to be observed here.

Inherently a critical air gap within the magnetic circuit coil of a drive is set up which has certain parasitic side effects and may pose problems particularly if, in fact, the various slot width within a print head differ for different armatures and needles. As a consequence of such variations the dynamics of the various print wires and their propelling system is subject to (temporal, force etc.) variations. In particular then, these different slot widths may lead to different periods of time between a trigger command and impact of the needle tip upon the print medium and the subsequent full retraction. Such difference in time may, for example, result in different print actions and produces accordingly a poor appearance of the printed character.

DESCRIPTION OF THE INVENTION

It is an object of the present invention to provide a new and improved armature assembling technique for matrix print heads meeting high requirements for accuracy without compromise in the economics as far as manufacture and mass production is concerned;

It is a feature of the present invention to provide a construction and assembly procedure for matrix print heads and the armature assembly therein which does not require tight tolerances of the parts being assembled in order to obviate the problem mentioned above, while still the energy as applied is to be used in maximum possible ways, during operation of the matrix print head.

In accordance with the preferred embodiment of the present invention, it is suggested to provide an annular armature ring which, however, does not serve as an integral element for armature arms, rather in the annular interior of that ring, a disk is concentrically arranged thereto and a separate resilient ring is, on one hand, placed unto the armature ring and fastened to the internal disk, whereby the resilient ring cover and annularly shaped, radial gap between armature ring and the disk surrounded by the little ring, and that a radial contour and arm shaped configuration are established through thermally cutting slots into the disk. From the economic point of view, the disk may originally be integral with but worked from and out of the circular armature ring with as little as possible waste produced in the making.

For practicing the invention it was found to be of advantage to establish concentricity between the armature ring and the disk through the connection with the spring arm ring which concentricity can be established very accurately by means of a positioning disk and armature ring and fastening the spring arms and ring thereto. Having established the requisite geometric relationship, this relationship remains even if subsequently the disk is subdivided by the slotting process.

In furtherance of the invention, it is suggested to begin the thermal slot cutting or scoring along the contour of the resilient arms under utilization of these gaps between the resilient arms. The cutting particularly uses the gaps or slots between the resolvent arms and begins not quite at the radial outer end of each such slot, which means that the slotting must begin at the gap between armature ring and disk. High accuracy of armature arm cutting obtains by using a laser beam for the cutting process.

In furtherance of the invention, it is suggested to provide both, armature ring and annulus in a common work step, e.g. by utilization of a flat ribbon mode of magnetizable iron. In other words, armature ring and annulus are more or less manufactured simultaneously. This form of practicing the invention or a process that begins with a ring shaped blank is finished along its inner periphery while separately blank-like disk is separately provided or cut out from the above mentioned ring and is finished along its outer periphery. This finishing work permits maximum possible adjustment with regard to the above-mentioned secondary (parasitic) air gap. In case the finishing work is deemed undesirable, it is suggested, still alternatively, to provide the armature ring as well as the disk by a sintering process using magnetic powder technology in such a manner that the respective finished product has already the desired dimentions.

In all cases in which the inner periphery of the armature ring, and the outer periphery of the disk of particularly made in one way or another as described, it is advisable, in accordance with the further features of the invention, that the annular gap between armature ring and annulus is dimensioned such that an uncritical parasitic air gap obtains under consideration of the tension bias system, for the electromagnetic drive, and the permanent magnet bias. Such an uncritical gap obtains in such a system radially between armature ring and the rearwardly directed face of the armature arms. Details thereof are described in out copending application Ser. No. 822,874, filed Jan. 22, 1986.

DESCRIPTION OF THE DRAWINGS

While the specification concludes with claims, particularly pointing out and distinctly claiming the subject matter which is regarded as the invention, it is believed that the invetion, the objects and features of the invention, and further objects, features and advantages thereof will be better understood from the following description taken in connection with the accompanying drawings, in which:

Proceeding now to the detailed description of the drawings, FIGS. 1 and 2 illustrate basically functions and overall assembly of a matrix print head to be used in a serial printer and illustrating in detail the purpose of the invention. Moreover, these figures show cooperation of a armature assembly within that head with other components thereof. Such a description ties the manufactured print head to the customary functions of printing.

Figure 1:
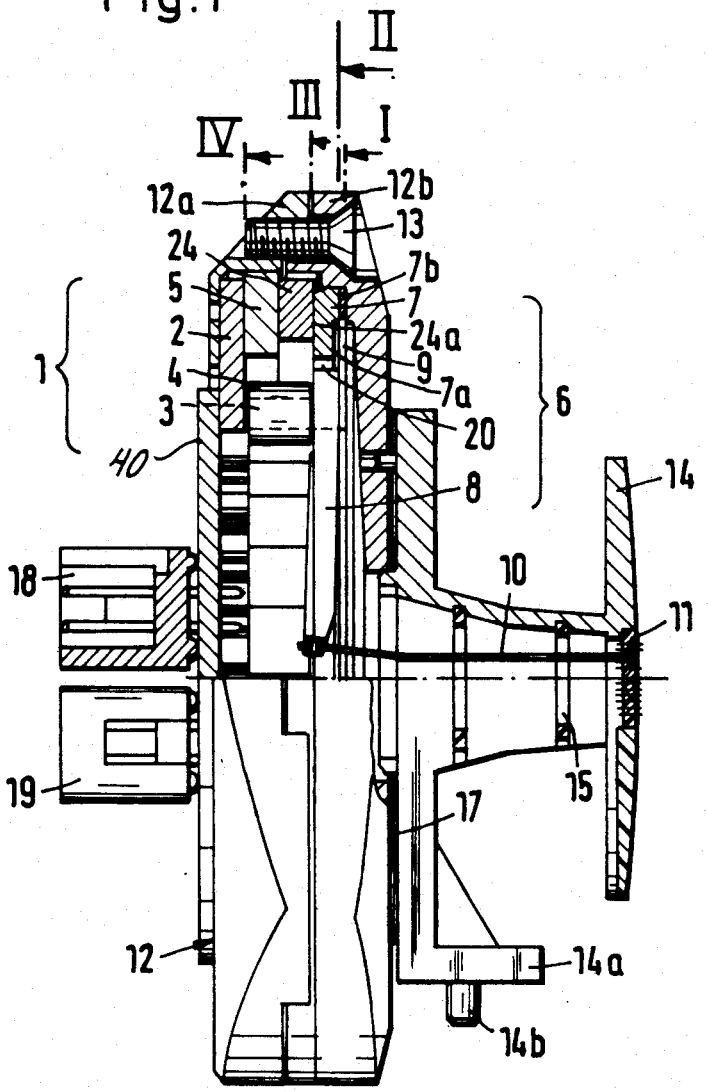
FIG. 1 is a matrix print head constructed in accordance with the preferred embodiment of the present invention for practicing the best mode thereof, the illustration being partially in sections and partially in side elevation, and indicating a plurality of a section plane identified by Roman numerals and extending transversely to the plane of the drawing of FIG. 1.
Figure 2:
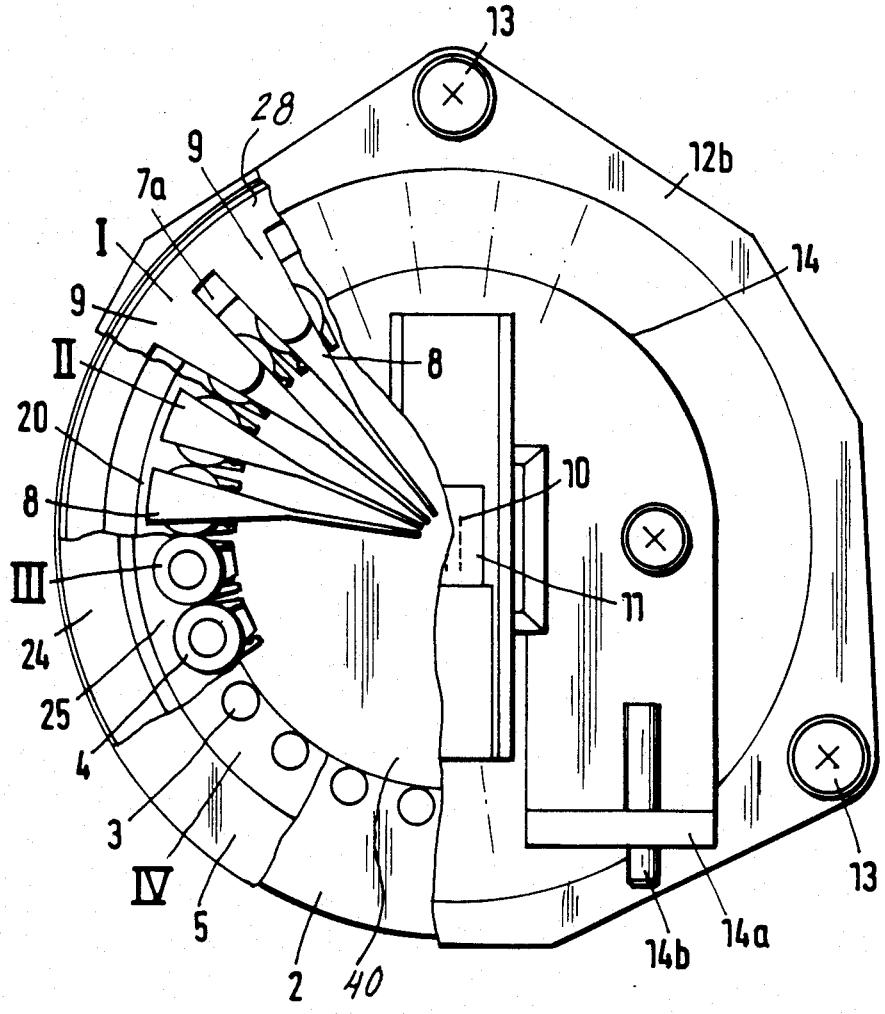
FIG. 2 is a composite drawing showing several annularly distributed section planes in plane view wherein the Roman numerals of FIG. 2 correspond to the similarly designated section planes of FIG. 1.

The serial type matrix print head illustrated in FIGS. 1 and 2 include unit or assembly 1 which is a composite electromagnetic system, and includes a yoke plate 2 common to all electromagnetic drivers of that system 1. The plate or disk 2 is provided for distributing the magnetic flux. A plurality of magnetic cores 3 defining poles is fastened to that plate 2. Each of these cores 3 carries an electromagnetic coil 4 to establish the individual drivers of this print head. In addition, a common permanent magnetic plate or ring 5 is provided for magnetically biasing all of these drivers.

The electromagnetic assembly 1 is juxtaposed to a second assembly called the armature group or assembly 6. This armature assembly 6 is comprised of an armature ring 7, as well as deflectable armature arms 8, which, as far as FIG. 1 is concerned, can be moved to the left and to the right. Each armature arms 8 is connected by means of relatively short resilient elements 9 to the armature ring 7. The number of cores 3 and coils 4 as well as the like number of arms 8 and spring arms 9 corresponds to a number of print elements such as relatively long needles, wire or style 10. The respective tips of these print elements are held, guided and mounted in a mouth piece 11.

In the particular example it is assumed that a total of 24 print elements are provided, and they are mounted within a casing 12 which is electrically insulating and also does not conduct a magnetic field. The casing or housing 12 is assembled from two housing or casing parts, 12*a* or 12*b*, which are held together by means of screws or bolts 13, being distributed around the periphery of that casing or housing as assembled.

The print elements 10 each can be shifted axially by a print travel path ranging between 0.3 and 0.6 mm. The movement is essentially an axial one but certain spreading or bending of the wires in radial direction is required in order to accommodate the difference in dimentions of the mouth piece as far as mounting the needle tips is concerned on one hand, and the comparatively bulkiness of the clustered magnetic drive system in the rear. These needles, styli or wires are axially movably disposed in a particular print element guide housing 14 and here particularly in a guide mounts 15 therein. The two housings or casings 12 and 14 are separate parts but are mounted together by means of bolts or otherwise, there being adjusting shims 17 of annular configuration interposed. These shims are thin elements and they are assembled and placed in between the two casings 12 and 14 in such number that for a given mounting situation of the print needles 10 in the drive system contained housing 12, one can adjust the deposition of the front tips of these needles in particular relationship to the front end of mouth piece 11. Moreover, the number of shims 17 is selectible and adjustable.

Accordingly the housing 14 is also used for fastening the print head as a whole to a carriage (not shown) which is movable in front of the printing platen which is likewise not shown. These parts are conventional and do not require elaboration. Housing 14 in particular is provided with an L-shaped mounting flange 14*a* for obtaining the fastening to the carriage and preferably at least two indexing pins 14*b* are provided for positioning of the print head very accurately in relation to the carriage.

Electric current is fed to the head and particularly the electromagnetic coils therein by means of flexible cable (not shown) and under utilization of a printed circuit board 40 also shown only schematically, and there being plug connections 18 and 19. Through these plugs connections are affected automatically to a controlled character generator by means of which the selectivity of drive element actuation is controlled.

An uncritical parasitic air gap 20 is provided between parts 7 and 8, which could act such that in case of minimal diviations of the magnetic flux density, and therefore, of the energy transmission as between the parts as well as during build-up and decay of the magnetic fields same negative interference could obtain. This seems to indicate criticality but the gap 20 will be uncritical if, in fact, the magnetic field across the gap is optimized as follows. The gap must be sufficiently large so that variations in the gap dimensions itself become insignificant. A non-critical aspect as far as the dimensions is concerned means that tolerances for making the armature ring 7 and the arms 8 do not have to be very tight, while on the other hand the operational characteristics are chosen such that the magnetic field line density is sufficiently high in order to balance the tension of the deflected resilient arms 9 but not so high that the magnetic field as set up across the gap and in the magnetic system throughout by a permanent magnet cannot rapidly be reduced by a magnetic field as set up by any of the coils 4 when energized. Basically, of course, this constitutes an ideal situation but is realized in accordance with the invention by assembling the armature as constructed as follows. This assembly has a corresponding aspect in the construction itself which is the subject of our copending application Ser. No. 822,874, filed Jan. 22, 1986.

An intermediate plate 24 is arranged between the magnetic yoke plate 2 and the armature ring 7. Plate 24 has a front face 24*a*, generally but being made to establish a single plane 25. This plane 25 is also seen in FIG. 2 and coincides with the plane of the drawing in the section portion III of that figure, the section plane being also indicated by III in FIG. 1. On the other hand, armature ring 7 will abut the intermediate plate 24 in that plane 25 provided the housing parts 12*a* and 12*b* are assembled. In case of retraction of needles 10, and attraction of the armature arms 8 by the poles of cores 3 on account of the permanent magnet 5, the arms 8 are positioned slightly obliquely to plane 25 as shown in FIG. 1. In that position, moreover, arms 8 abut the respectively associated cores 3. The thickness of the armature ring 7 corresponds, approximately, to the thickness of arms 8 plus the relatively thin dimensions of resilient arm 9. Please note, that on account of the long lever arm 8, the small travel path of the needles is translated into a much smaller travel path of that portion of any armature arm 8 that is adjacent to respective core 3.

The resilient arms or bridges 9 are connected on one hand to the respective armature arms 8, and on the other hand, to the common armature ring 7. The spring arms or bridges 9 are relatively short and there short clamping area is obtained through a step 7*a* such that a residual annular surface 7*b* remains for the connection, while on the other hand the step 7*a* ensures bending the freedom for bending of the armature arms 8; also, step 7*a* may consitute a continuation of the air gap 20.

The short spring arms 9 may alternatively be made of an anti-magnetic material such as chromium-nickel-steel so that, in fact, no magnetic field lines will run through the arms 9 or the area of step 7*a*. Another limiting action of stray flux or another concentration of the magnetic field lines results from the yoke plate 2 which ends approximately in the radial disposition of the cores 3 where radially facing the print elements 10.

For making some of its parts and assembling this head 1 one should procede as follows. At first the prepared armature ring 7 and disk 27 are arranged in concentric relationship, the disk 27 being placed in the interior 26 of ring 7. These two parts are interconnected with a prepared resilient arm ring 28 being provided with short arms 9 separated by slots 9*a*. Rings 7 and 28 are preferably placed very accurately in concentric relationship as far as their respective outer periphery is concerned. The disk 27 will be placed into the internal ring space 26 circumscribed by ring 7 so as to be accurately concentric to the two parts 7 and 28.

Having placed these three parts e.g. by means of a suitable jig into this critical concentric relationship, one will, for example, use spot welding or riveting or the like, in order to fasten the arms 9 to the disk 27, and ring 7 may be spot welded or riveted to ring 28 from which the resilient arms 9 project. The arms 9, therefore, will now project beyond an annular gap 29 between ring 7 and disk 27 and are rigidly connected between armature ring 7 and disk 27, to thereby establish a rigid connection between these parts 7 and 27, as can also be seen from FIGS. 3 and 3*a*.

Figure 4:
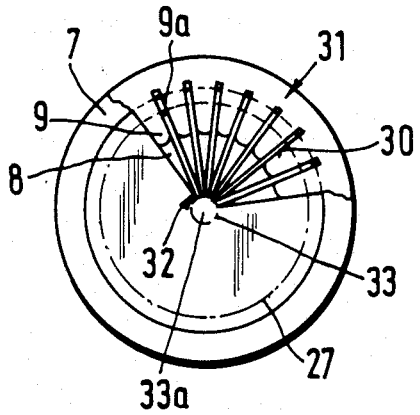
FIG. 4 is a front view of the armature assembly following slot cutting of and into the disk.
Figure 4A:
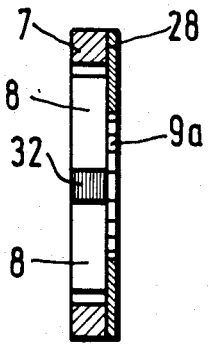
FIG. 4*a* is a perpendicular cross-section through the armature assembly as shown in FIG. 4.

Now, the gaps 9*a* between the resilient arms 9 are completed by establishing the lateral contour through burning, melting or the like, to obtain slots 31 in disk 27 extending in radial direction as shown in FIGS. 4 and 4*a*. The melting process is preferably carried out by means of a laser beam. The dimensions of this cutting establishes predetermined slot widths between remaining parts of disk 27 as a consequence of the fact that the cut slots 31 have a finite width, and they all converge on the center of disk 27. This means that a central opening results in the disk and the disk 27 is in effect divided into many sectors each of which is fastened to a spring arm 9. Also, peak portions 32 obtain as the ultimate result of having made a plurality of separate arms 8. The tips 32 are all situated upon a predetermined closed line 33. This slot providing step carried out generally through application of heat will preferably begin corresponding to the predetermined notches 9*a* of ring 28 right at the gap 29, and will proceed as to each slot radially from there.

After the slots 31 have been formed, the armature assembly as such is completed and has actually been produced with highest possible precision. It is now merely necessary to assemble this armature group or assembly with the others which will be described later. However, first certain preparatory steps will be described in order to illustrate how armature ring 7 and the disk 37 can by themselves be made at the necessary accuracy. This procedure will be described with reference to FIGS. 5 through 10.

Figure 5:
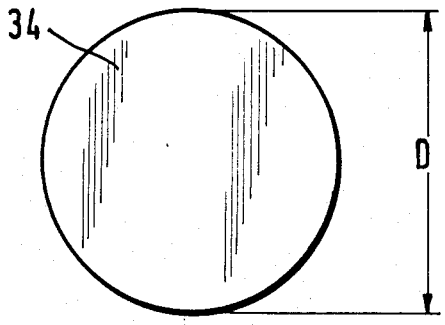
FIG. 5 illustrates a blank for the annular armature ring prior to cutting the disk out of this blank.
Figure 7:
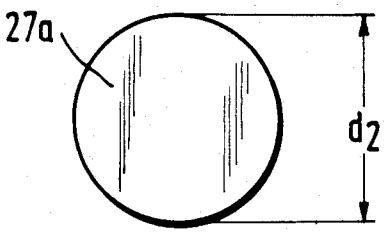
FIG. 7 illustrates separately the disk cut from the blank shown in FIG. 5.

By way of example, a magnetic iron type flat ribbon or strip is used in order to stamp out round discs 34 (FIG. 5). Erodizing or some other cutting method can be used instead of stamping. Each part 34 is now assumed to have an outer diameter D which does not (or is not expected to) meet the requisite accuracy requirements. Before, however, proceeding further each disc 34 is, so to speak used as a blank in order to provide therefrom a blank-like disk 27*a*. Hardly any waste will result from this procedure as is also derivable from FIG. 6. This blank annulus 27*a* has a diameter d1. Blank annulus 27*a* can alternatively be made with a somewhat smaller diameter d2, as shown in FIG. 7. In the first instance it will be necessary to widen the interior space of ring 7 somewhat by increasing the diameter from d1 to d1′, as shown in FIG. 9, while on the other hand, the outer periphery of the raw or blank annulus 27*a* is somewhat reduced from d1 or d2, through fine finish to obtain the final dimension d2′, as shown in FIG. 8.

Figure 8:
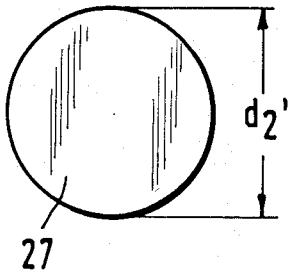
FIG. 8 illustrates the disk after fine finishing.
Figure 6:
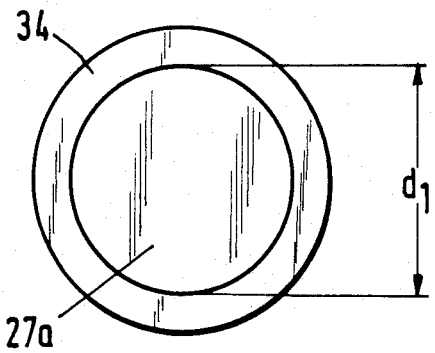
FIG. 6 illustrates the annular armature ring following removal of what will subsequently be the concentric disk.
Figure 9:
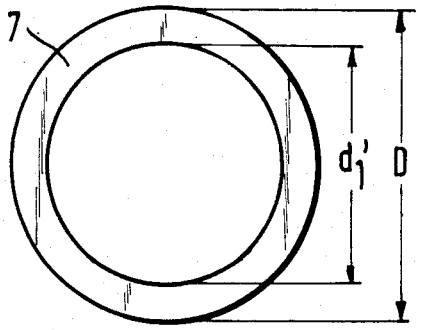
FIG. 9 illustrates the annular armature ring following fine finish of its inner periphery.
Figure 10:
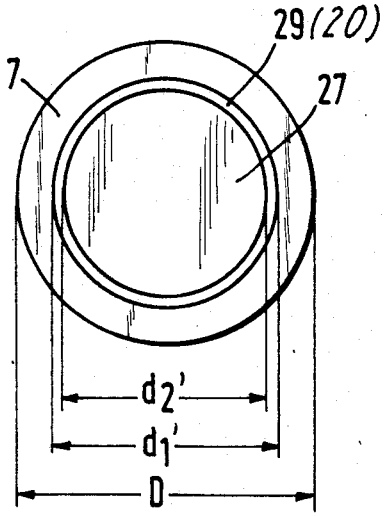
FIG. 10 illustrates the insertion of the finished disk into the finished annular armature ring and in a concentric relationship but prior to placement of the resilient arm ring upon both of them.

Alternatively, armature ring 7 and annulus 27 can be made separately through powder metal press working and processing of magnetizable powder and sintering the part so made to obtain the requisite diameters D, and/or d1′ and d2′, as shown in FIGS. 8, 9, and 10.

Figure 3:
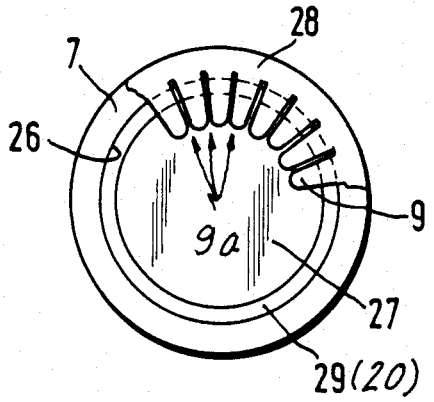
FIG. 3 is a front view of an armature assembly being comprised of an armature ring, a disk, and a resilient arm ring, the latter having been omitted partially.
Figure 3A:
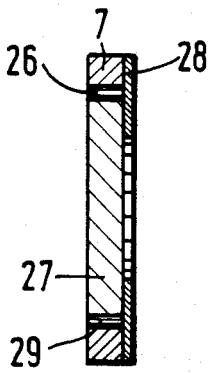
FIG. 3*a* is a transverse axial section through the assembly shown in FIG. 3.

Irrespective of the manufacturing mode employed, the parts as made and when concentrically placed are as shown in FIG. 10. Thus, the parts shown in FIG. 10 constitute a subcomponent for making the head and driver assembly as was described above with reference in FIGS. 3, 3*a*, 4, and 4*a*. The phase as per FIG. 10, therefore, takes into consideration that the ring gap 29 between armature ring 7 and disk 27 is dimensioned so as to obtain the value referred to above generally, and having the dimensions of a non-critical parasitic air gap 20 as defined above, and illustrated in FIG. 1. The relationship (identity) between the manufactured gap 29, and the operative air gap 20 is indicated in FIGS. 3 and 10. This aspect then applies particularly to the biased electromagnetic-permanent magnetic-resilient system as illustrated and invisioned here.

The parts made either through stamping or sintering, i.e. armature ring 7 and disk 27, may in cases be made alternatively through a precision casting process to obtain the requisite final dimensions D, d1, and d2′. Again, in this case, which is somewhat more expensive, one will obtain the various parts to be assembled as per FIGS. 2, 3*a*, 4, and 4*a*, and resulting ultimately in accurately positioned and dimensioned resilient arms 9 and armature arms 8. The position accuracy in all instances is the basic prerequisite for a successful assembly of this armature assembly, including flat resilient arms 9 and thicker armature arms 8, whereby, and this is one of the critical and important advantages of the invention, one does not have to have special guide structures for the arms 8.

The invention is not limited to the embodiments described above; but all changes and modifications thereof, not constituting departures from the spirit and scope of the invention, are intended to be included.

We claim:

1. Method of making an armature assembly for matrix print heads including a plurality of magnetic drives for a corresponding plurality of print elements, comprising the steps of:

providing an annular armature ring;

providing a disk;

positioning said disk inside said armature ring in a concentric relation thereto with an annular gap between;

providing a resilient arm ring comprising a ring with a plurality of arms extending radially therefrom and superimposing said arm ring upon said disk and said armature rings so as to establish concentric placement thereto;

fastening the arm ring to said armature ring and the arms of the arm ring to said disk such that the ring arms extend above the annular gap between said armature ring and said disk; and thermally cutting slots into said disk to obtain individual armature arms, the slots extending through said disk to divide the disk into individual arms that remain connected to the armature ring on account of said fastening step.

2. Method as in claim 1 said thermal slot providing being carried out by means of a laser.

3. Method as in claim 1 and including the step of originally providing said armature ring and said disk in a single step and as a single part; providing said disk as a cut-out from said ring and finishing an outer periphery of the disk as well as an inner periphery of the ring to obtain the requisite dimensions.

4. Method as in claim 1 including the steps of separately providing said armature ring and said annulus by means of sintering.

* * * * *